US006000960A

United States Patent [19]

Wang et al.

[11] Patent Number: 6,000,960

[45] Date of Patent: Dec. 14, 1999

[54] FOLDABLE RETAINER DEVICE

[75] Inventors: Pei-Rong Wang, Taipei Hsien; Ching-Ho Lai, Ta-Hsi Chen, both of Taiwan

[73] Assignee: Hon Hai Precision Inds.Co., Ltd., Taipei Hsien, Taiwan

[21] Appl. No.: 09/120,167

[22] Filed: Jul. 21, 1998

[30] Foreign Application Priority Data

Aug. 28, 1997 [TW] Taiwan ..... 86214882

[51] Int. Cl.[6] ..... H01R 13/15

[52] U.S. Cl. ..... 439/327; 439/328

[58] Field of Search ..... 439/65, 325, 358, 439/629, 633, 681, 637, 816, 59, 296, 395, 326, 327

[56] References Cited

U.S. PATENT DOCUMENTS 3,829,741 8/1974 Athey ..... 317/101

5,207,598 5/1993 Yamada et al. ..... 439/637

*Primary Examiner*—Paula Bradley

*Assistant Examiner*—Alexander Gilman

[57] ABSTRACT

A foldable retainer device includes a pair of clamping members pivotably connected to distal ends of an elongate base frame, and a folding mechanism for retaining the pair of clamping members either perpendicular or parallel to the base frame.

10 Claims, 9 Drawing Sheets

FOLDABLE RETAINER DEVICE

BACKGROUND OF THE INVENTION

1. Field of The Invention

The present invention relates to a foldable retainer device, and particularly to a foldable retainer device installed on a mother board for retaining components such as a modularized CPU card, and for conserving space during transport before configuration with the CPU card.

2. The Prior Art

A modularized PC board or CPU card has become a trend in the PC industry. Traditionally, the CPU is connected to a mother board either via a connector or direct soldering. However, an advanced manufacturing technique has replaced this by firstly soldering the CPU onto a printed circuit board and then inserting the printed circuit board into a connector mounted on the mother board. Alternatively, the CPU is firstly combined with the PC board as a modularized unit and is then inserted into a connector mounted on the mother board. However, either the PC board or the modularized card is elevated above the connector, therefore, the PC board or the modularized card is apt to vibrate and adversely affect signal transmission. Normally, a retainer device is configured beside the connector in order to further fix the PC board or the modularized card. The related U.S. Pat. Nos. are 3,993,390; 4,057,879; 5,207,598; 5,259,793; 5,429,523; 2,825,037; and 3,829,741. However, the retainer devices as disclosed in the above patents have a U-shaped clamping structure including two upright arms for retaining the modularized card. Since the two upright arms respectively extend upright at two opposite ends of the elongated base of the retainer, thus resulting in occupying relatively huge space itself, the transport thereof becomes inconvenient. Therefore, an improved retainer device with less dimension which is adapted to be stacked one by one during shipping while still providing the standard dimension for retaining the modularized card during operation, is earnestly requested.

SUMMARY OF THE INVENTION

The primary purpose of the present invention is to provide a foldable retainer device which can decrease the upright height thereof when folded thus facilitating transport of the retainer device.

In accordance with one aspect of the present invention, a foldable retainer device comprises a pair of clamping members pivotably connected to distal ends of an elongate base frame fixed on a mother board, and a folding mechanism having matingly engaged pivots and pivot holes respectively formed in the base frame and the clamping member for pivotable movement of each clamping member with respect to the base frame. A first positioning unit has a protrusion portion around each pivot and a groove portion defined around each pivot hole for pivotably receiving the protrusion portion and retaining each clamping ember at different angles with respect to the base frame.

DETAILED DESCRIPTION OF THE PREFERRED EMBODIMENT

Figure 1:
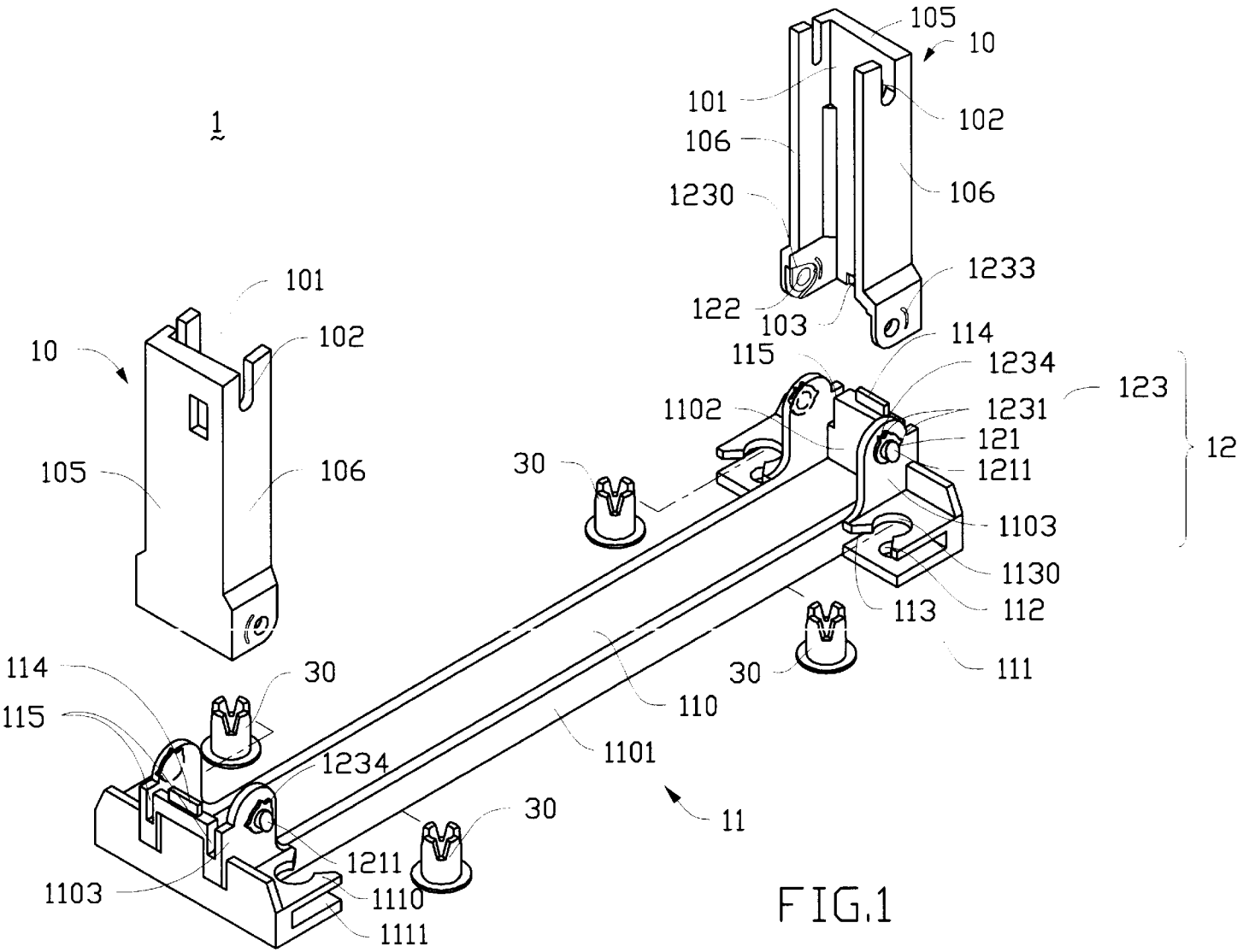
FIG. 1 is an exploded view of a foldable retainer device including a pair of clamping members, a base frame, and a foldable mechanism in accordance with the present invention.

Referring to FIG. 1, a foldable retainer device 1 in accordance with the present invention comprises a pair of clamping members 10 pivotably connected to distal ends of a base frame 11, and a folding mechanism 12 for retaining the pair of clamping members 10 either perpendicular or parallel to the base frame 11.

Figure 3A:
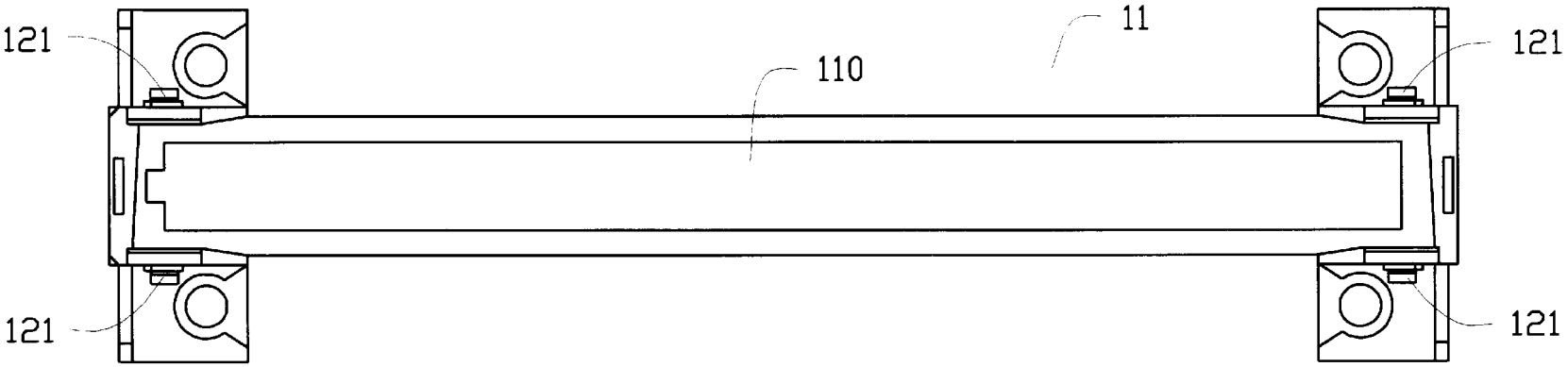
FIG. 3A is a top view of the base frame of FIG. 1.
Figure 3B:
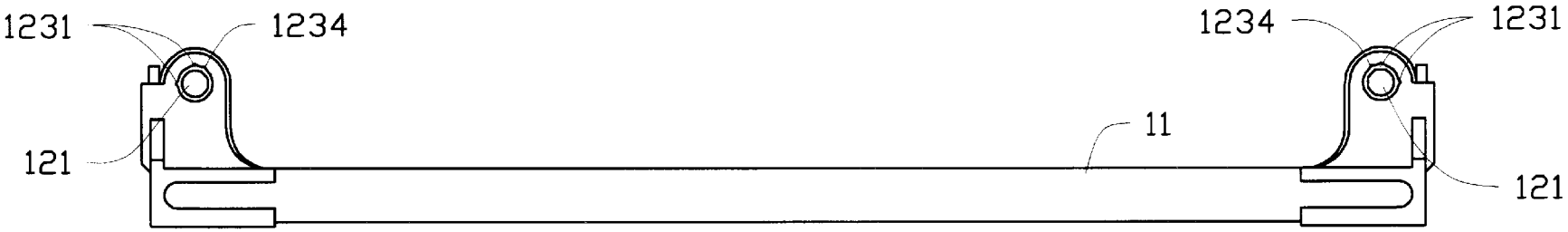
FIG. 3B is a front view of the base frame.

Also referring to FIGS. 3A and 3B, the base frame 11 comprises a rectangular opening housing 110 having a closure structure for retaining a connector (not shown) therein. The housing 110 has two parallel longitudinal walls 1101 connected to two lateral walls 1102, wherein the lateral wall 1102 is higher than the longitudinal wall 1101. An intermediate wall 1103 having a round upper portion (not labeled) is formed adjacent to each side of each lateral wall 1102 substantially higher than the lateral wall 1102, therefore there are four intermediate walls 1103 in four corners of the housing 110, respectively.

Figure 5A:
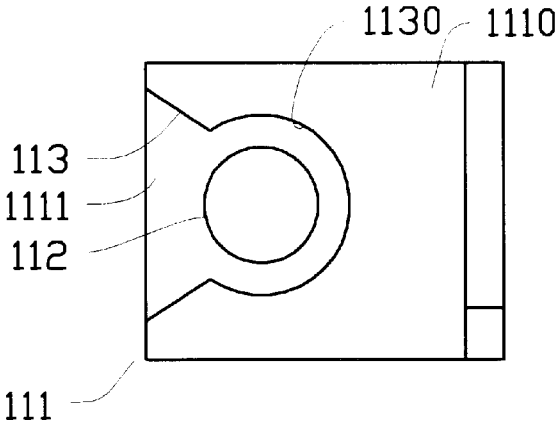
FIGS. 5A and 5B respectively illustrate the top and side views of the side receptacle of FIG. 1.
Figure 5B:
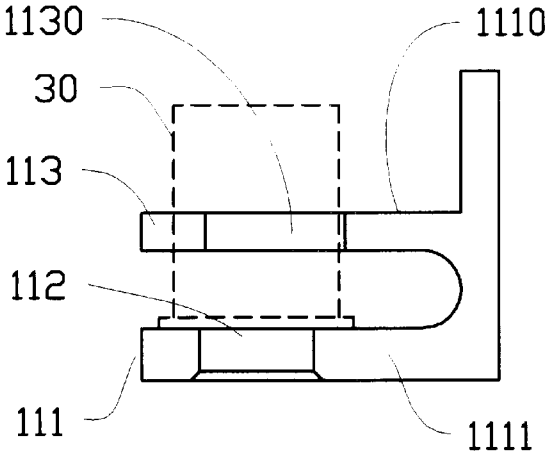

Referring to FIGS. 5A and 5B as well as FIG. 1, a side receptacle 111 extends from each intermediate wall 1103 for receiving a collar member 30 therein. Each side receptacle 111 has an upper layer 1110 and a lower layer 1111 spaced from each other a distance equal to the height of the longitudinal wall 1101. An upper hole 1130 is defined in the upper layer 1110 from which a cutout 113 diverges. A lower hole 112 is defined in the lower layer 1111 substantially in alignment with the upper hole 1130. The collar member 30 is forcibly inserted into the upper hole 1130 via the cutout 113 and the bottom thereof is seated on a periphery of the lower hole 112. The collar member 30 has an outer diameter equaling the diameter of the upper hole 1130 therefore the collar member 30 can be fixed in the side receptacle 111. The collar member 30 also has inner threads (not shown) having a diameter equaling the diameter of the lower hole 112. The collar member 30 is adapted to be received in the side receptacle 111 so that the inner threads thereof are in alignment with the lower hole 112 for engagement with a mother board (not shown) via a bolt (not shown).

Figure 2A:
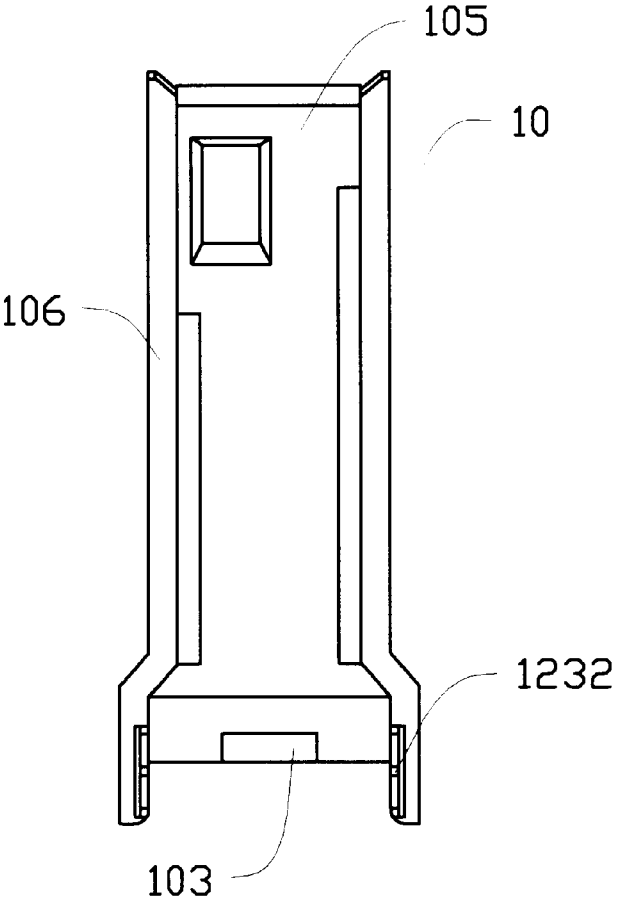
FIG. 2A is a front view of a clamping member of FIG. 1.
Figure 2B:
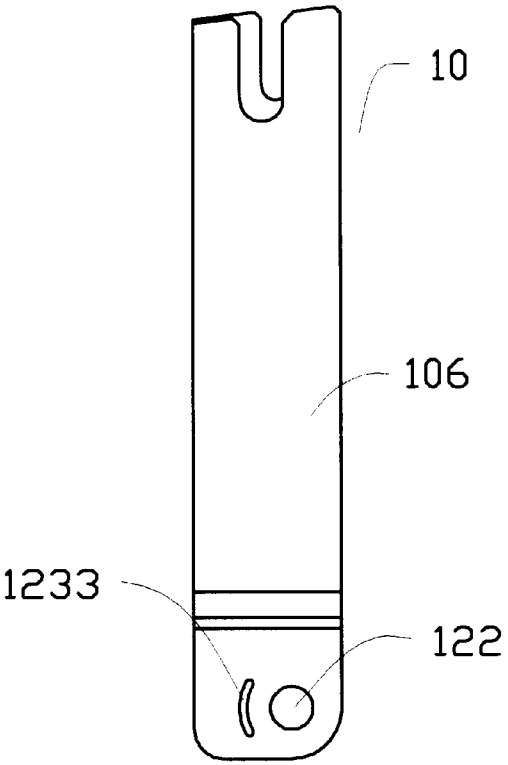
FIG. 2B is a side view of the clamping member of FIG. 2A.
Figure 2C:
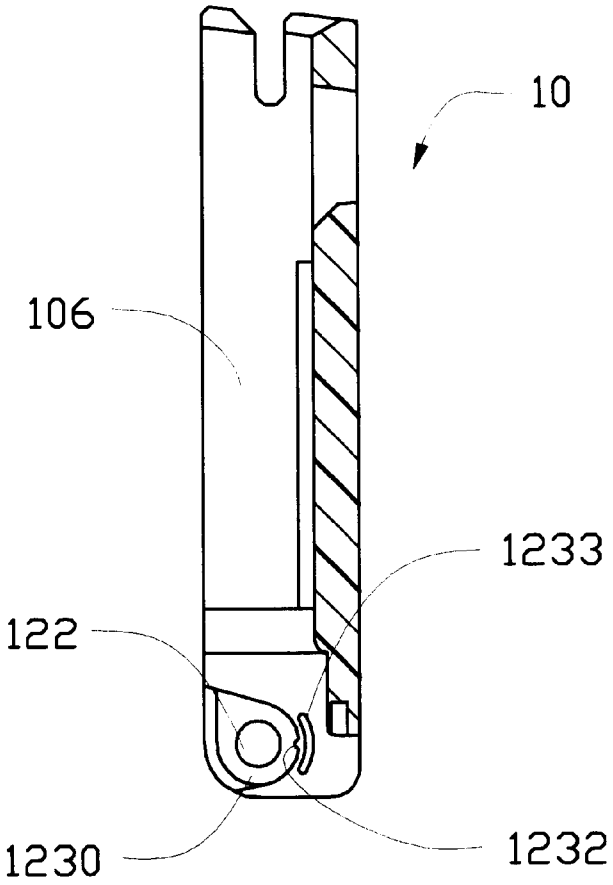
FIG. 2C is a cross-sectional view of the clamping member.

Referring to FIGS. 2A to 2C as well as FIG. 1, each clamping member 10 is substantially a U-shaped structure having a base 105 and two side walls 106 respectively extending upright from two sides thereof thus defining a card recess 101 therebetween for reception of the side-edge portion of a modularized card (not shown) of which a lower portion is received within the aforementioned connector disposed in the opening housing 110. A cutout 102 is defined at a top edge of each side wall 106 for engagement with the modularized card.

Figure 6:
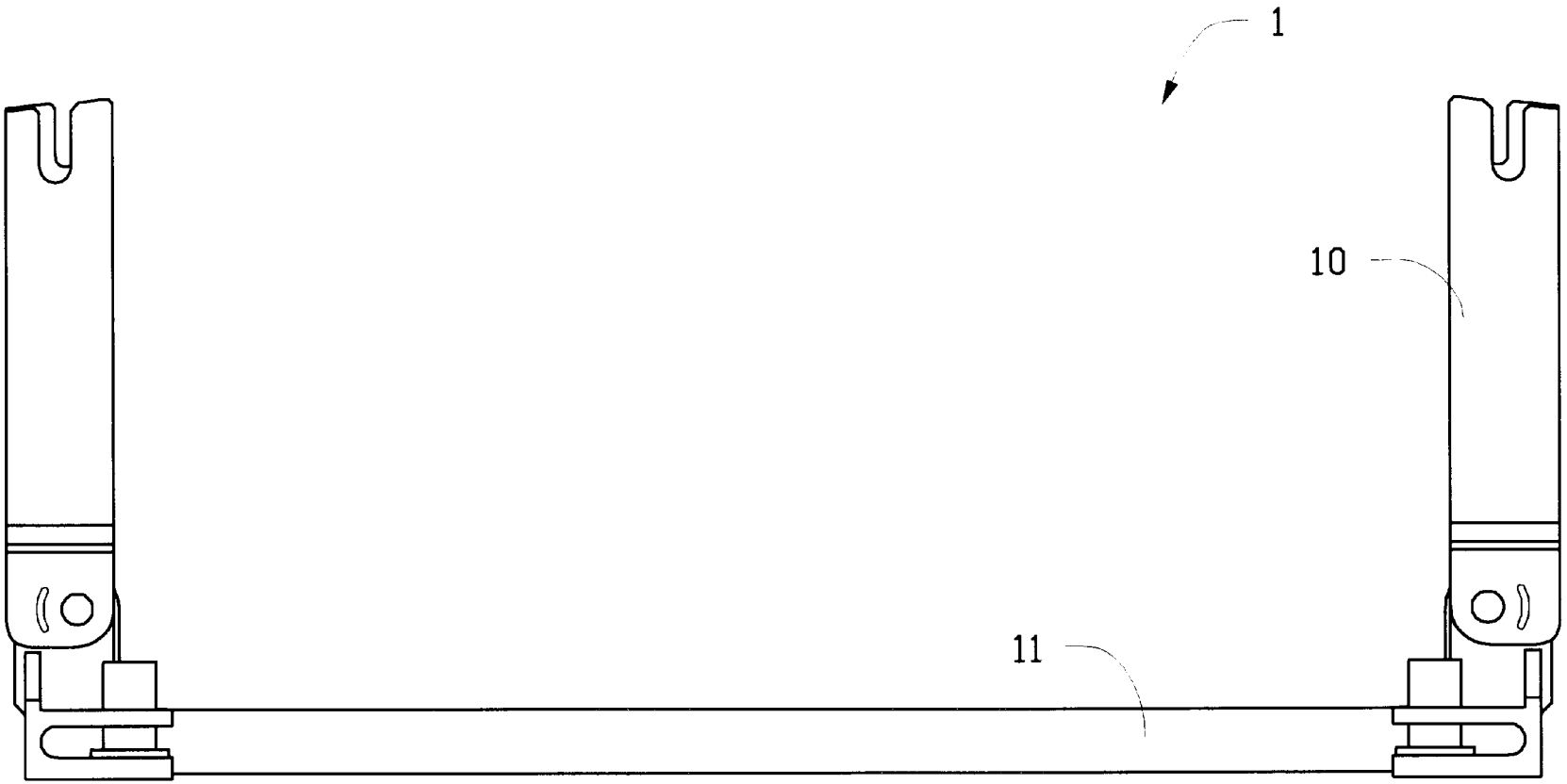
FIG. 6 is an elevational view showing the foldable retainer device of the present invention in an extended status.
Figure 7:
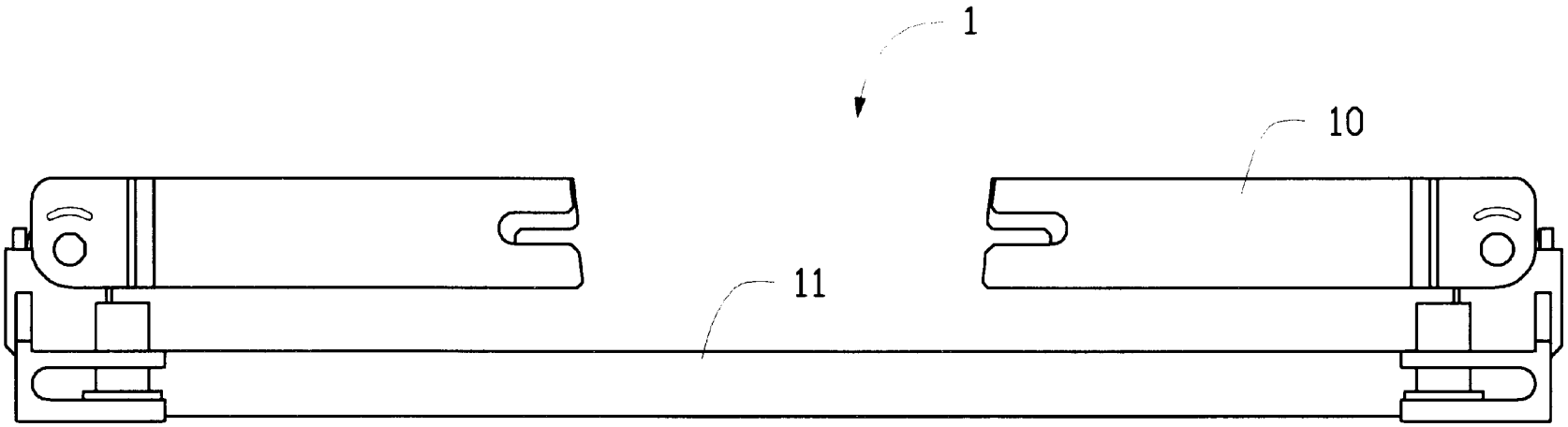
FIG. 7 is an elevational view showing the foldable retainer device of the present invention in a folded status.

Referring to FIGS. 6, 7, 8A and 8B as well as FIG. 1, the folding mechanism 12 comprises a pair of pivots 121 respectively extending outward from the intermediate walls 1103, a pair of aligned pivot holes 122 defined in lower portions of the side walls 106 of the clamping member 10 for pivotably receiving the pivots 121, and a first positioning unit 123 for retaining the clamping member 10 either perpendicular or parallel to the base frame 11 (best seen in FIGS. 6 and 7). The first positioning unit 123 comprises a protrusion portion 1231 formed on the outer surface of the intermediate wall 1103 around the pivot 121 and a groove 1230 formed on an inner surface of the side wall 106 around the pivot hole 122, wherein the protrusion portion 1231 is pivotally received in the groove 1230. The pivot 121 has a slant top face 1211 for facilitating engagement with the pivot hole 122 of the clamping member 10.

Figure 4A:
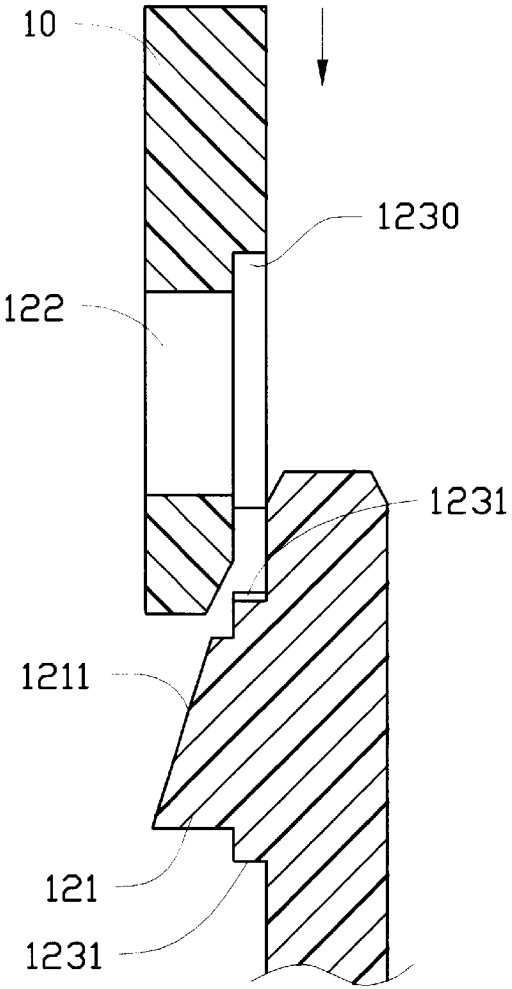
FIGS. 4A to 4C illustrate how the clamping member is assembled with the base frame.
Figure 4B:
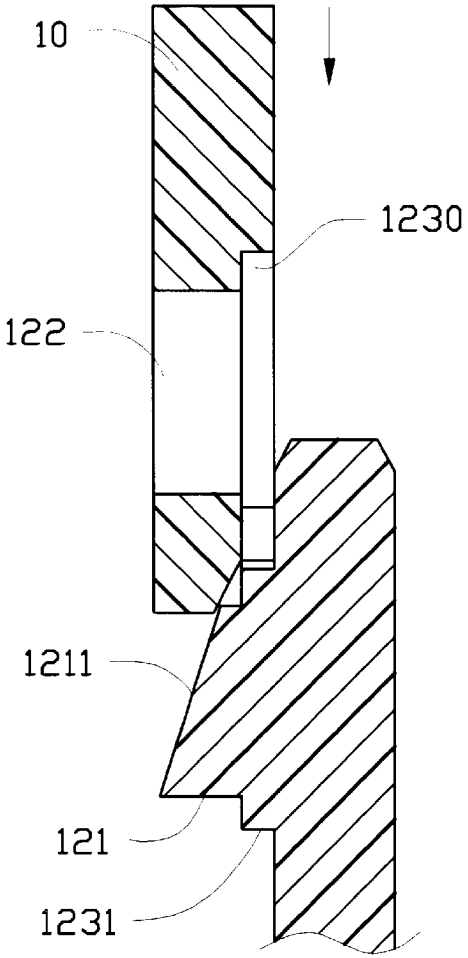
Figure 4C:
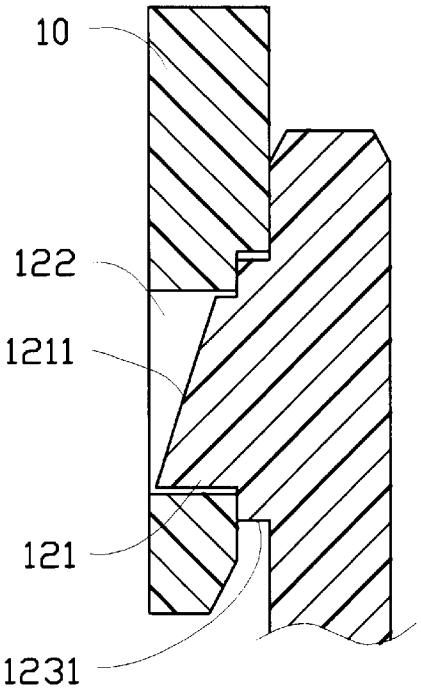
Figure 8B:
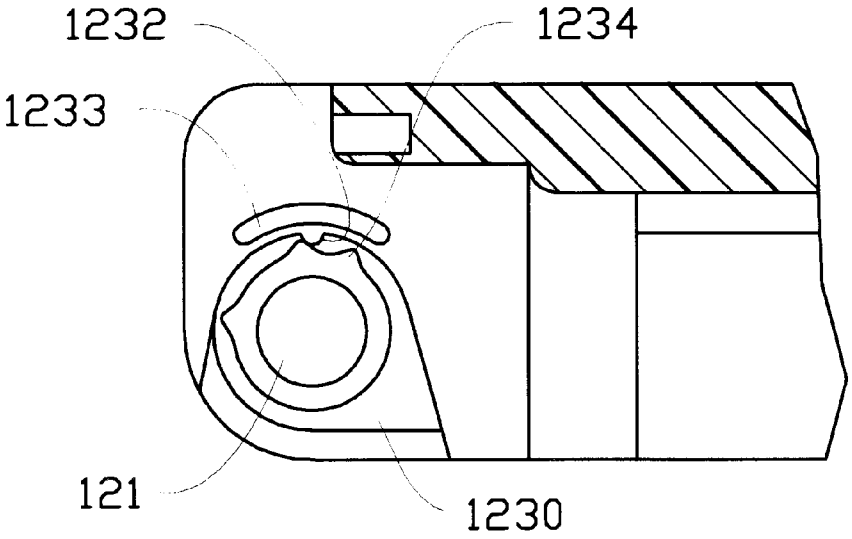
FIG. 8B is a partially cross-sectional view showing the joint relation between the clamping member and the base frame when the foldable retainer device is in a folded status.
Figure 8A:
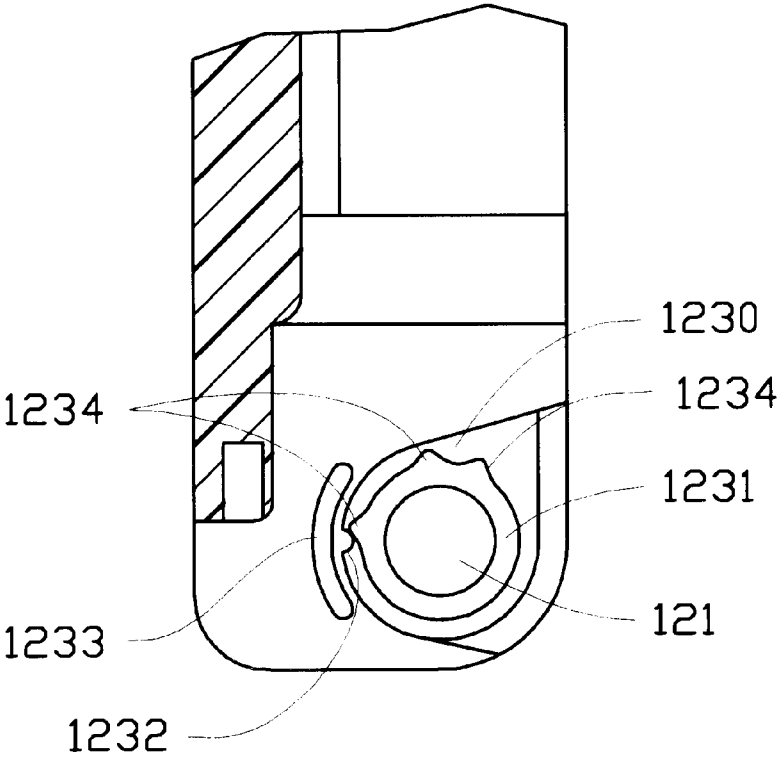
FIG. 8A is a partial cross-sectional view showing the joint relation between the clamping member and the base frame when the foldable retainer device is in an extended status.

FIGS. 4A to 4C illustrate the configuration between the clamping member 10 and the base frame 11, wherein the slant face 1211 is tapered upward, therefore, the clamping member 10 easily slides downward along the slant face 1211 of the pivot 121 until the pivot hole 122 receives the pivot 121 and the groove 1230 receives the protrusion portion 1231. Specifically referring to FIGS. 8A and 8B, at least three digits 1234 extends outward from the protrusion portion 1231 located around at least a quarter of the periphery thereof. A tongue 1232 formed to extend into the groove 1230 of the inner surface of the side wall 106 consecutively abuts against each digit 1234 when the clamping member 10 is rotated with respect to the pivot 121 of the base frame 11. Therefore, the clamping member 10 can be retained at a required angle with respect to the base frame 11 whenever the tongue 1232 abuts against one of the digits 1234 of the protrusion portion 1230. Basically, the clamping member 10 can be retained at least at two angles with respect to the base frame 11, which are either perpendicular or parallel to the base frame 11 as shown in FIGS. 8A and 8B, respectively. One of the digits 1234 (see FIG. 8B) can abut against the tongue 1232 of the clamping member 10 thereby preventing the clamping member 10 from moving below a horizontal level when the clamping member 10 is folded to be parallel to the base frame 11.

A curved slot 1233 provides a tolerance space which prevents the clamping member 10 from breaking after repeated rotations with respect to the base frame 11.

The foldable retainer device 1 can be used with a connector and a modularized card only when it is extended. Therefore, for further retaining the two clamping members 10 in the extended status, in addition to the first positioning unit 123, a second positioning unit is provided. The second positioning unit comprises a protrusion plate 114 extending upward from an upper edge of the lateral wall 1102 of the base frame 11 and a groove 103 defined in an inner surface of the clamping member 10 for receiving the protrusion plate 114 thereby preventing the clamping member 10 from being outwardly folded beyond a position perpendicular to the base frame 11. A slit 115 is defined in the connection corner of the side wall 1102 and the intermediate wall 1103 in order to provide a tolerance space for the intermediate wall 1103 during configuration of the clamping member 10 and the intermediate wall 1103 and during rotation of the clamping member 10 with respect to the base frame 11.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A foldable retainer device having a pair of clamping members pivotably connected to distal ends of an elongate base frame fixed on a mother board, and a folding mechanism having matingly engaged pivots and pivot holes respectively formed in the base frame and the clamping member for pivotal movement of each clamping member with respect to the base frame and a first positioning unit having a protrusion portion around each pivot and groove portion defined around each pivot hole for pivotably receiving the protrusion portion and retaining each clamping member at different angles with respect to the base frame;

wherein the protrusion portion around the pivot has a plurality of digits extending outward from at least a quarter of a periphery thereof and the groove around the pivot hole has a contacting tongue extending therefrom for abutting with the digits in order to retain the clamping member at different angles with respect to the base frame.

2. The foldable retainer device as claimed in claim 1, wherein at least two of the digits are angled with respect to the pivot for providing a ninety degree difference therebetween thus the clamping member is operative to be either perpendicular or parallel to the base frame.

3. The foldable retainer device as claimed in claim 2, wherein the pivot has a slanted top face tapering upward for reception by the pivot hole of the clamping member.

4. The foldable retainer device as claimed in claim 3 further comprising a curved slot formed near the pivot hole for providing a tolerance space which prevents the clamping member from breaking after repeated rotations with respect to the base frame.

5. The foldable retainer device as claimed in claim 4, wherein one of the plurality of digits extending from the protrusion portion can abut against the tongue of the clamping member thereby preventing the clamping member from moving beyond a horizontal level when the clamping member is folded to be parallel to the base frame.

6. The foldable retainer device as claimed in claim 5, wherein the base frame is a rectangular closure having two parallel longitudinal walls connected to two lateral walls, two intermediate walls formed adjacent to two sides of each lateral wall and having the pivot extending therefrom, and a slit defined in the connection portion of the side wall and the intermediate wall in order to provide a tolerance space for the intermediate wall during configuration of the clamping member and the curved wall.

7. The foldable retainer device as claimed in claim 6 further comprising a second positioning unit having a protrusion plate extending upward from an upper edge of the lateral wall of the base frame and a groove defined in an inner surface of the clamping member for receiving the protrusion plate thereby preventing the clamping member from being outwardly folded beyond a position perpendicular to the base frame.

8. The foldable retainer device as claimed in claim 7, wherein a side receptacle extends from each intermediate wall for receiving a collar member therein, each side receptacle having an upper layer and a lower layer spaced from each other a distance equal to the height of the longitudinal wall, an upper hole defined in the upper layer from which a cutout diverges, and a lower hole defined in the lower layer substantially in alignment with the upper hole, whereby the collar member is forcibly inserted into the upper hole via the cutout and the bottom thereof is seated on a periphery of the lower hole.

9. The foldable retainer device as claimed in claim 8, wherein each clamping member is substantially a U-shaped structure having a base and two side walls extending upright from two sides thereof thus defining a card recess therebetween for reception of a modularized card.

10. A foldable retainer device having a pair of clamping members pivotably connected to distal ends of an elongate base frame fixed on a mother board, and a folding mechanism having matingly engaged pivots and pivot holes respectively formed in the base frame and the clamping member for pivotal movement of each clamping member with respect to the base frame and a first positioning unit having a protrusion portion around each pivot and groove portion defined around each pivot hole for pivotably receiving the protrusion portion and retaining each clamping member at least at three different angles with respect to the base frame.

* * * * *